US005937869A

United States Patent [19]

Lhuisset

[11] Patent Number: 5,937,869

[45] Date of Patent: Aug. 17, 1999

[54] CONTAINER AND ITS ASSOCIATED BRUSH FOR APPLYING MASCARA

[75] Inventor: François Noël Benoît Lhuisset, Montgeron, France

[73] Assignee: LVMH Recherche, Nanterre, France

[21] Appl. No.: 08/930,990

[22] PCT Filed: Apr. 12, 1996

[86] PCT No.: PCT/FR96/00568

§ 371 Date: Jan. 7, 1998

§ 102(e) Date: Jan. 7, 1998

[87] PCT Pub. No.: WO96/32033

PCT Pub. Date: Oct. 17, 1996

[30] Foreign Application Priority Data

Apr. 14, 1995 [FR] France ..... 95 04545

[51] Int. Cl.[6] ..... A45D 40/26; A46B 11/00

[52] U.S. Cl. ..... 132/218; 132/320; 401/122; 401/126; 401/127

[58] Field of Search ..... 132/218, 320; 401/122, 126, 129, 127

[56] References Cited

U.S. PATENT DOCUMENTS

| | | | |
|---|---|---|---|
| 2,627,619 | 2/1953 | Gagen | 15/121.3 |
| 3,957,066 | 5/1976 | Dahm | 132/88 |
| 4,390,298 | 6/1983 | Carluccio | 401/122 |
| 4,407,311 | 10/1983 | Gueret | 132/218 |
| 4,705,053 | 11/1987 | Goncalves | 132/218 |
| 4,810,122 | 3/1989 | Cole | 401/122 |
| 4,927,281 | 5/1990 | Gueret | 401/129 |
| 5,137,387 | 8/1992 | Byrd et al. | 401/122 |
| 5,309,029 | 5/1994 | Toll | 132/218 |
| 5,339,841 | 8/1994 | Gueret | 132/218 |
| 5,397,193 | 3/1995 | Kirk | 401/122 |

FOREIGN PATENT DOCUMENTS 558468 8/1923 France .

*Primary Examiner*—John J. Wilson
*Assistant Examiner*—Trang Duan
*Attorney, Agent, or Firm*—Pennie & Edmonds LLP

[57] ABSTRACT

A container and a related brush for applying mascara are disclosed. A sleeve (3) with a non-circular opening (4) is freely rotatably mounted in the neck (2) of the container (1), and a brush (8) with a non-circular cross-section matching the shape of the opening (4) is supported by a rod (6) that also has a non-circular cross-section and is shaped to fit said opening (4). The rod is attached to a cap (5) thus enabling the brush (8) to be inserted into the neck (2) of the container (1) and withdrawn therefrom in such a way that excess mascara is effectively scraped off the brush (8) at the opening (4) of the sleeve (3). Mascara may thus be applied accurately to the eyelashes alone.

8 Claims, 3 Drawing Sheets

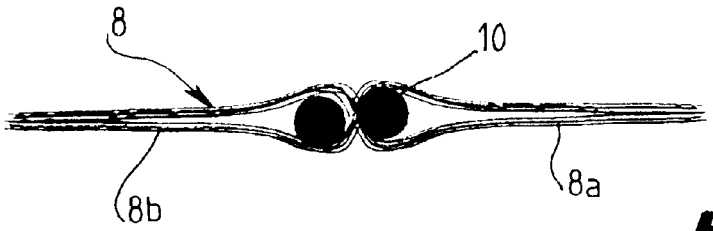
Fig. 7
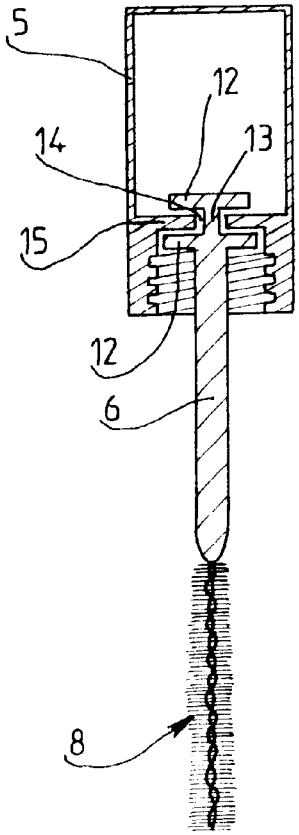
Fig. 8
Fig. 9
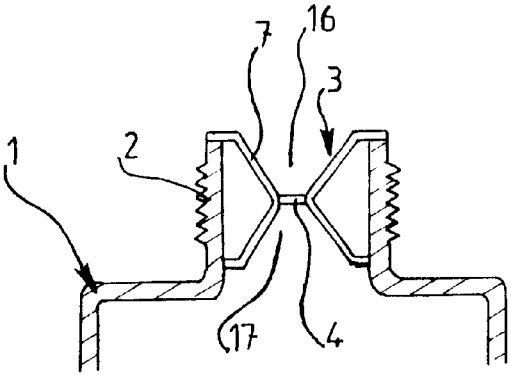

CONTAINER AND ITS ASSOCIATED BRUSH FOR APPLYING MASCARA

TECHNICAL FIELD

The present invention has essentially as its subject a container and a brush associated with this container for permitting in particular the application of mascara onto the eyelashes.

BACKGROUND ART

The containers for mascara are generally in the shape of a tube and commonly consist of a scraping means forming a narrowed opening for the passage of the brush and accommodated in the neck of the container.

Thus the brush could be inserted into the container and it could also be wiped dry during its withdrawal from the container.

Presently conventional mascara brushes, due to their generally circular shape, prevent getting near the root of the lash since they interfere with the eyelid or even with the eye itself.

It therefore is clearly preferable to use mascara applying brushes comprising one or several sheets of bristles having in a way a shape of a tooth-brush. Thus, this type of brush will be more effective for the application of mascara onto the lashes of the eye.

However until now such brushes owing to their shape are not compatible with the present scraping systems comprising a generally circular opening which may therefore not permit the effective dry-wiping of a brush of the type or of the general shape of a tooth-brush.

Therefore the present invention has as its object to propose a container-brush combination which solves the hereabove problems.

SUMMARY OF THE INVENTION

For that purpose, the invention has as its subject a container and its associated brush for the application of mascara, comprising a scraping means accommodated in the neck of the container to permit the insertion of the brush into the container as well as the dry-wiping of the said brush during its withdrawal from the container, wherein the scraping means is constituted by a sleeve the wall of which is shaped so as to permit the guiding and the directing of the brush towards and into an opening with a non-circular shape and corresponding substantially to the shape of the brush itself, which also has a non-circular cross-section.

According to another characteristic of the invention, the sleeve comprises at least one substantially conical part the apex of which constitutes the said opening.

The aforesaid sleeve is freely rotatably mounted into the neck of the container.

One thus already understands that upon the insertion of the brush, there will occur a forced rotation of the sleeve within the neck of the container so that the said brush will place itself automatically in correspondingly registering relationship with the opening of the sleeve so that it may move through this opening.

According to another embodiment, the sleeve is mounted in stationary relationship within the neck of the container whereas the brush is freely rotatably mounted onto a cap or the like for closing the container.

One should further specify that the brush is made fast to a stem exhibiting in cross-section a non-circular shape corresponding substantially to that of the aforesaid opening in the sleeve.

According to another characteristic of this invention, the opening in the sleeve exhibits the shape of an elongated hole whereas the brush is formed of at least one sheet of bristles extending substantially in a plane at the end of the stem.

According to another embodiment, the wall of the sleeve defines therein two recesses in the shape of cones opposite to each other with their apexes where the aforesaid opening is located.

Thus, during the insertion into as well as the withdrawal from the container, the brush will advantageously be guided and directed towards and into the non-circular opening formed at the level of the apex of both opposite cones.

BRIEF DESCRIPTION OF THE DRAWINGS

But further advantages and characteristics of the invention will appear in the detailed description which follows and refers to the attached drawings given by way of example only and in which:

FIG. 7 is a diagrammatic view on a larger scale and in cross-section of the brush along the line VII—VII of FIG. 5;

FIG. 8 is a view in axial section on a smaller scale of another embodiment of the cap onto which the brush is freely rotatably mounted;

FIG. 9 partially illustrates in axial section a container the neck of which is provided with a sleeve according to another alternative embodiment.

DETAILED DESCRIPTION OF THE PREFERRED EMBODIMENTS

Figure 2:
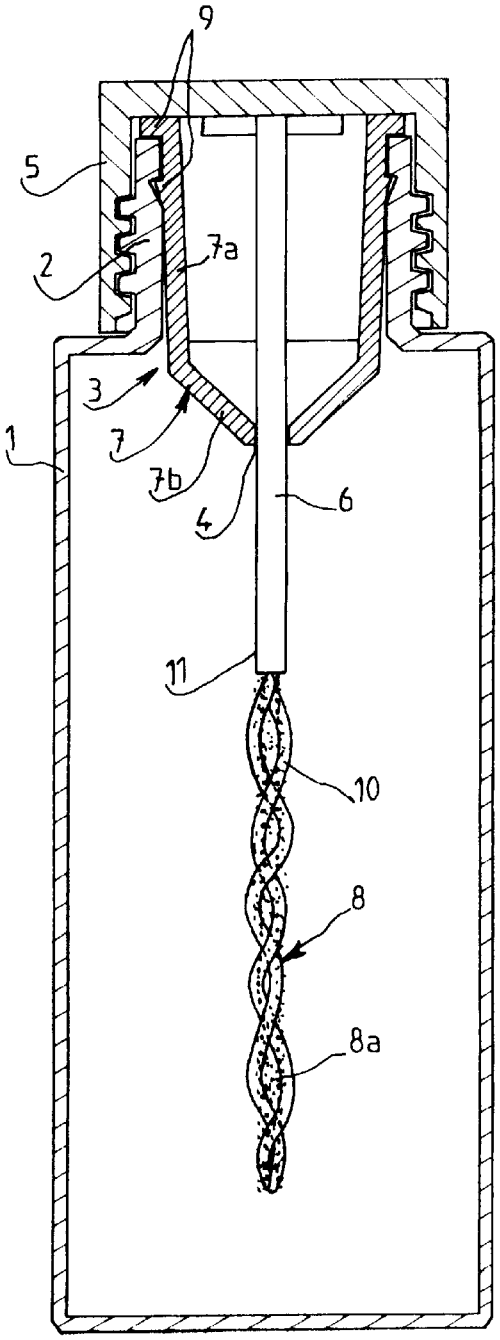
FIG. 2 is a view in axial section but made along the line II—II of FIG. 1.

If one refers in particular to FIGS. 1 to 5 which show one embodiment of the container with the associated brush according to this invention, one sees a container 1 the externally threaded neck 2 of which is provided inside with a sleeve 3 having an opening 4, the neck 2 being closed by a cap 5 carrying a stem 6 at the end of which is provided a brush 8.

The wall 7 of the sleeve 3 comprises at least one substantially conical portion, i.e. in the example shown, two successive tapered parts 7*a*, 7*b* the apex of which constitutes the opening 4 and this in a manner to permit the guiding and the directing of the brush 8 with its associated stem 6 towards and into the opening 4.

Although this has not been shown, the wall 7 of the sleeve 3 could be provided inside with a relief in the shape of a portion of a helix for example, which will facilitate the rotation and the guiding of the arrangement constituted by the sleeve 3 and the brush 8.

Figure 1:
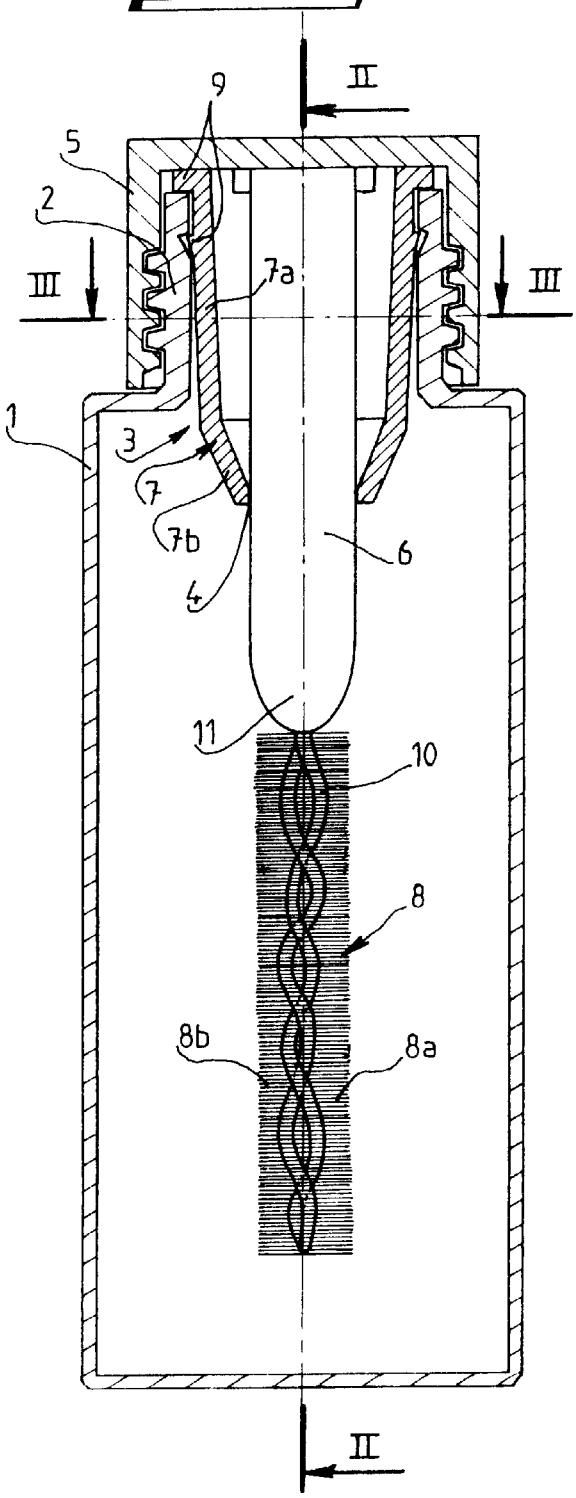
FIG. 1 is a view in axial section of a closed container fitted with the means according to this invention and inside of which is dipping a brush formed of one or several sheets of bristles extending along a plane at the end of a stem carried by a cap.

As it will clearly appear on FIGS. 1 and 2, the end of the sleeve 3 opposite to the opening 4 is mounted into the neck 2 of the container 1 and this so that it may freely turn in this neck.

According to the example shown, the sleeve 3 is axially retained within the neck 2 by shoulders such as 9 without preventing the free rotation of the sleeve.

Of course means others than the shoulders 9 may be provided for accomplishing the function described herebefore without departing from the scope of the invention.

Figure 3:
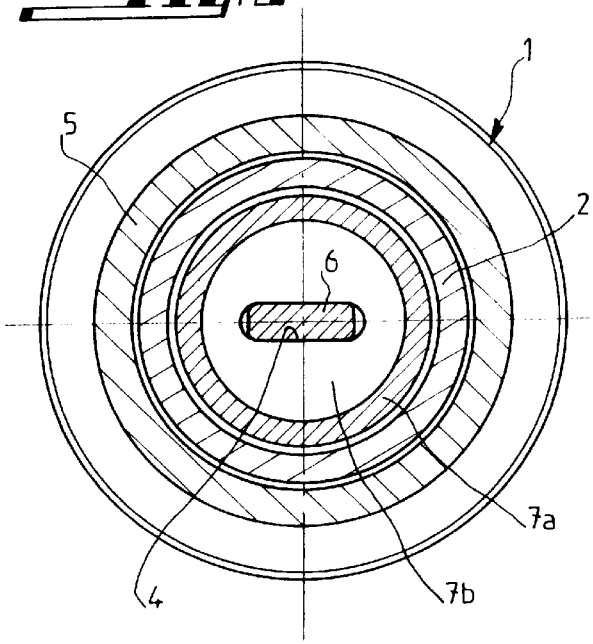
FIG. 3 is a view in cross-section made along the line III—III of FIG. 1.
Figure 4:
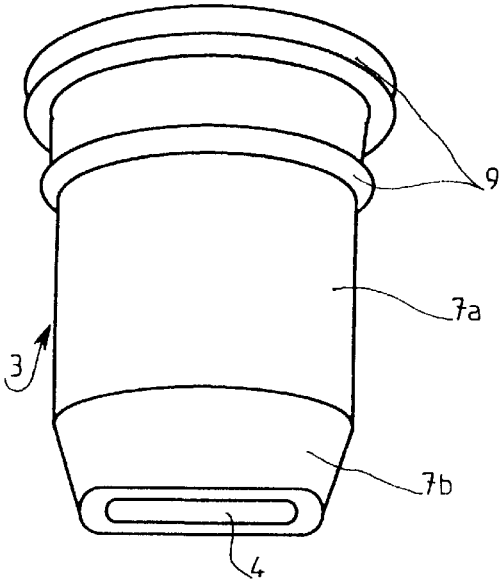
FIG. 4 is a perspective view of a sleeve fitting the neck of the container.

The opening 4 of the sleeve 3 exhibits a non-circular shape namely for example the shape of a rectangular or oblong hole or even of a slot as best seen in FIGS. 3 and 4.

The brush 8 as best seen in FIG. 7 itself also exhibits a non-circular shape in cross-section corresponding substantially to the shape of the opening 4. This brush 8 according to the exemplary embodiment shown is formed of two sheets of bristles 8*a*, 8*b* for example carried by a metal twist 10 itself made fast to the stem 6 fastened onto the cap 5. These sheets 8*a*, 8*b* are arranged in a same plane on either side of the stem 6 and are formed each one of two rows of bristles.

Figure 5:
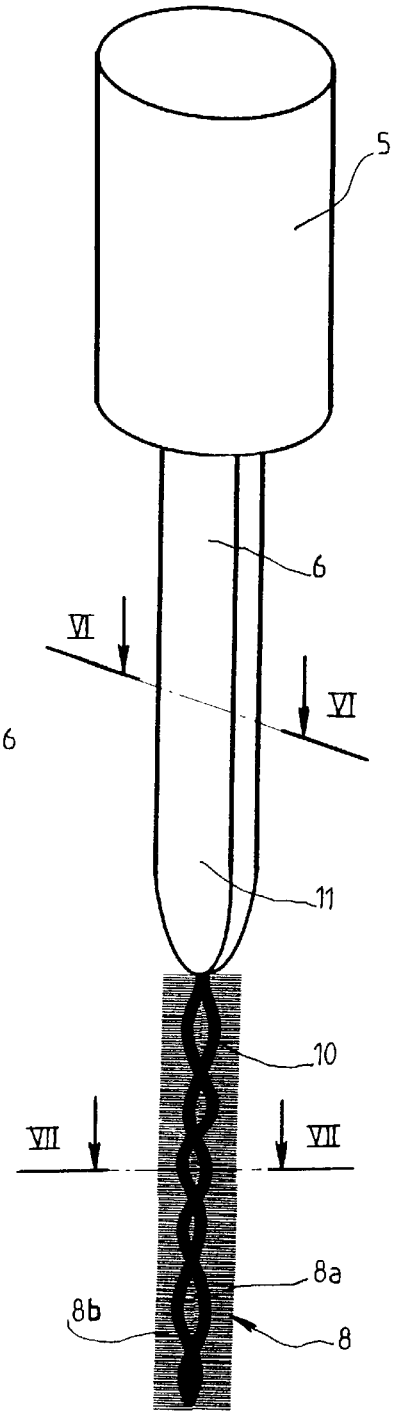
FIG. 5 is a diagrammatic perspective view of the brush carried by its stem made fast to the cap.
Figure 6:
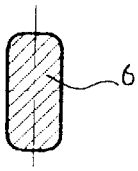
FIG. 6 is a view in cross-section of the stem along the line VI—VI of FIG. 5.

The stem 6 as one sees it well on FIGS. 5 and 6 itself also exhibits a non-circular shape such for example as a rectangular shape corresponding substantially to that of the opening 4 of the sleeve 3.

One should remark that the stem 6 at the level of its connection to the brush 8 comprises a bevelled portion 11 which on the one hand will promote the start of the rotation of the sleeve 3 as one will describe it in detail hereinafter and which on the other hand will avoid the nipping of the bristles of the brush 8 between the wall 7 of the sleeve 3 and the stem 6, which nipping would risk to cause a sudden resistance during the insertion of the brush into the container 1.

One understands from the foregoing that the non-circular shape of the opening 4 of the sleeve 3 will correspond substantially to the also non-circular shape in cross-section of the stem 6 as well as of the brush 8.

For a better understanding of the invention, one will briefly explain the operation of the assembly which has just been described, in the following.

The cap 5 having been unscrewed from the neck 2 of the container 1, when one desires after a making-up operation to reinsert the brush 8 into the container 1, the brush guided by the wall 7 of the sleeve 3 will cause a rotation of the latter until the brush 8 in correspondingly registering relationship with the oblong opening 4 so that the said brush and the stem 6 will move through the said opening, it being understood that during the screwing of the cap 5 onto the neck 2, the stem 6 and its associated brush 8 will turn within the neck 2 while rotating the sleeve 3 which is loosely mounted within the neck. It will result therefrom that in the closed position of the container 1, the opening 4 and the stem 6 will be positively retained in correspondingly mating relationship so that when one desires to use the brush 8, the withdrawal of the latter after unscrewing of the cap 5 will result in that the said brush may be withdrawn by passing through the opening 4 without any difficulty.

In addition, it is important to remark here that the dry-wiping of the brush 8 during its withdrawal and its passage through the opening 4 will be particularly effective owing to the substantially identical shapes of the said opening and of the said brush and this although the brush is flat hence with a non-circular symmetry and therefore not lending well itself owing to its shape to a dry-wiping by moving through a circular opening. Moreover the dry-wiping will be perfect, i.e. neither to strong nor insufficient.

According to another embodiment, the sleeve 3 could be mounted in stationary relationship for example by being force-fitted into the neck 2 of the container 1.

In this case, the stem 6 carrying the brush 6 should be freely rotatably mounted in the cap 5 as this is shown on FIG. 8.

According to the exemplary embodiment shown on this Figure, one sees that the stem 6 comprises at its end opposite to that carrying the brush 8 two transverse shoulders 12 retaining it axially within the cap 5 while permitting it to freely turn in this cap. One indeed sees that the step 6 extends with its portion 13 which has a circular section between both shoulders 12, through an aperture 14 with a slightly greater diameter and formed in a transverse wall 15 forming an integral part of the cap 5. But one perfectly could without departing from the scope of the invention imagine any other alternative embodiment permitting the axial retaining and the free rotation of the stem 6 in the cap 5.

Thus with the sleeve 3 mounted in stationary relationship within the neck 2 of the container, when one will insert the stem 6 and its associated brush into the container 1, the sleeve 7 will of course not turn but it is the brush 8 and the stem 6 which will turn with respect to the cap 5 and this under the effect of the substantially conical shape of the wall 7 of the sleeve 3 until at last the brush 8 comes in correspondingly registering relationship with the opening 4 so that it may move through this opening.

During the withdrawal of the brush from the container 1, the stem 6 owing to its shape corresponding to that of the opening 4 in the sleeve 3 will permit the passage of the brush 8 through the opening 4 for undergoing the desired dry-wiping as previously explained since the bristles will co-operate with the edges of this opening which, as once again said, exhibits a contour with a shape corresponding to that to the envelope of the brush.

Referring to the alternative embodiment illustrated by FIG. 9, one sees here that the sleeve 3 within the neck 2 of the container 1 comprises a wall 7 defining two recesses 16, 17 in the shape of cones opposite to each other with their apex where is located the opening 4 previously described and having an oblong and substantially rectangular shape corresponding substantially to the shape in cross-section of the brush.

The sleeve 3 may here be mounted in stationary or even freely rotatable relationship within the neck 2, the recesses 16 and 17 facilitating the insertion of the brush into the container 1 and its withdrawal from the said container, respectively. One should remark that in this alternative embodiment, the cross-section of the stem carrying the brush could be of any shape including a circular shape.

One has thus provided according to the invention a container with an associated brush having a shape particularly adapted to carry out an effective application of mascara onto the lashes, which container permits to carry out an effective and uniform dry-wiping of this brush during withdrawal from the container although this brush has a non-circular section.

The invention is of course not at all limited to the embodiments described and illustrated which have been given by way of example only.

Thus the shape in cross-section of the brush and of the stem which carries it as well as the shape of the opening in the sleeve made fast to the neck of the container may assume any asymmetrical shape on condition that the shapes of these various elements be substantially corresponding shapes. Likewise the fastening of the bristles of the brush onto the stem and the turning or non-turning fastening of the stem onto the cap may be of any kind. Moreover the brush could be replaced with any like applicator element requiring a dry-wiping such as a comb, small brush, flexible blade, foam or other one.

This means that the invention comprises all the technical equivalents of the means described as well as their combinations if the latter are within the scope of the claims which follow.

I claim:

1. A container and brush member assembly comprising:

a container for mascara material having a neck;

a sleeve freely and rotatably mounted within the neck for wiping at least a portion of the brush member, said sleeve having a wall including at least one substantially conical portion, the apex of which has an oblong opening; and a brush member having a brush on a first end, a cap on a second end, and a stem therebetween with a cross-section substantially conforming in shape to the opening and fixedly attached to the cap, whereby insertion of the brush member into the container provides a rotation of the sleeve until the brush member and the opening are correspondingly aligned so that the brush member may move through the opening.

2. The container and brush member assembly of claim 1, wherein the wall of the sleeve includes a first conical part having a first apex followed by a second conical part connected to the first apex and having a second apex including said opening.

3. The container and brush member assembly of claim 1, wherein the wall of said sleeve defines two cones with their apexes opposite to each other, and said opening is located between said apexes.

4. The container and brush member assembly of claim 1, wherein the stem includes a beveled portion at the end which connects to the brush.

5. A container for mascara material having a neck;

a sleeve fixedly mounted within the neck for wiping at least a portion of the brush member, said sleeve having a wall including at least one substantially conical portion, the apex of which has an oblong opening; and a brush member having a brush on a first end, a cap on a second end, and a stem therebetween with a cross-section substantially conforming in shape to the opening and attached to the cap having a means for axially retaining said stem while permitting free rotation of the stem within the cap, whereby the insertion of said brush member into the container will provide a forced rotation of the sleeve until the brush member and the opening are correspondingly aligned so that the brush member assembly may move through the opening.

6. The container and brush member assembly of claim 5, wherein the wall of the sleeve includes a first conical part having a first apex followed by a second conical part connected to the first apex and having a second apex including said opening.

7. The container and brush member assembly of claim 5, wherein the wall of said sleeve defines two cones with their apexes opposite to each other, and said opening is located between said apexes.

8. The container and brush member assembly of claim 5, wherein the stem includes a beveled portion at the end which connects to the brush.

* * * * *